US011456113B2

(12) United States Patent
Mikogami et al.

(10) Patent No.: US 11,456,113 B2
(45) Date of Patent: Sep. 27, 2022

(54) COIL COMPONENT

(71) Applicant: TDK CORPORATION, Tokyo (JP)

(72) Inventors: Tasuku Mikogami, Tokyo (JP); Shuhei Someya, Tokyo (JP); Syun Ashizawa, Tokyo (JP); Setu Tsuchida, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 564 days.

(21) Appl. No.: 16/379,033

(22) Filed: Apr. 9, 2019

(65) Prior Publication Data

US 2019/0318866 A1 Oct. 17, 2019

(30) Foreign Application Priority Data

Apr. 12, 2018 (JP) ..... JP2018-076659

(51) Int. Cl.
*H01F 17/04* (2006.01)
*H01F 27/29* (2006.01)
*H01F 27/28* (2006.01)

(52) U.S. Cl.
CPC ..... *H01F 27/29* (2013.01); *H01F 27/2823* (2013.01)

(58) Field of Classification Search
USPC ..... 336/221, 192
See application file for complete search history.

(56) References Cited

U.S. PATENT DOCUMENTS

| | | | | |
|---|---|---|---|---|
| 2015/0162126 | A1 | 6/2015 | Kanbe et al. | |
| 2015/0287520 | A1 | 10/2015 | Takagi et al. | |
| 2016/0217918 | A1 | 7/2016 | Shiokawa | |
| 2016/0365191 | A1* | 12/2016 | Horie | H01F 27/24 |
| 2019/0272952 | A1 | 9/2019 | Yasuoka et al. | |

FOREIGN PATENT DOCUMENTS

| | | | |
|---|---|---|---|
| JP | H09219318 | A | 8/1997 |
| JP | 2005-56934 | A | 3/2005 |
| JP | 2006-49383 | A | 2/2006 |
| JP | 2017-45903 | A | 3/2017 |

OTHER PUBLICATIONS

English translation of JP2010165862 (Year: 2010).*
English translation of JP2003077730 (Year: 2003).*

* cited by examiner

*Primary Examiner* — Ronald Hinson
(74) *Attorney, Agent, or Firm* — Young Law Firm, P.C.

(57) ABSTRACT

Disclosed herein is a coil component that includes: a core including a winding core part extending in a first direction and a flange part provided at one end of the winding core part in the first direction, the flange part having a first surface substantially parallel with the first direction; a plate-like member fixed to the first surface of flange part; and a wire wound around the winding core part. The first surface of flange part has a cut part greater in size than a diameter of the wire.

17 Claims, 12 Drawing Sheets

COIL COMPONENT

BACKGROUND OF THE INVENTION

Field of the Invention

The present invention relates to a coil component and, more particularly, to a coil component using a drum-shaped core.

Description of Related Art

A coil component using a drum-shaped core is widely used in electronic devices such as smartphones for the reason that it is smaller in size than a coil component using a toroidal-shaped core and can be mounted on the surface of a circuit board. The drum-shaped core has a winding core part around which wires are wound and a pair of flange parts provided at both axial end portions of the winding core part, and end portions of respective wires are connected respectively to a plurality of terminal electrodes provided on each of the flange parts. Further, there may be a case where a plate-like member is bonded to the upper surface of the drum-shaped core for the purpose of facilitating handling of the coil component at mounting (see JP 09-219318 A). In this case, the wires are positioned between the winding core part and the plate-like member.

However, in the configuration where the plate-like member is bonded to the drum-shaped core, when a displacement occurs in wire winding positions, the wires and plate-like member may interfere with each other. That is, when the wires are densely wound as designed, the wires and the plate-like member do not interfere with each other; however, when the wires are wound in a position different from the one expected by design, or when a space is generated due to failure of dense winding, the last turn of one wire is wound overlapping the previous turn, for example, thus failing to house the last turn between the winding core part and plate-like member.

SUMMARY

It is therefore an object of the present invention to prevent interference between the wires and the plate-like member in the coil component using the drum-shaped core.

A coil component according to the present invention includes a drum-shaped core including a winding core part, a first flange part provided at one axial end of the winding core part, and a second flange part provided at other axial end of the winding core part; a plate-like member; a plurality of terminal electrodes provided on each of the first and second flange parts; and a plurality of wires wound around the winding core part such that one end of each wire is connected to any one of the plurality of terminal electrodes provided on the first flange part and other end of each wire is connected to any one of the plurality of terminal electrodes provided on the second flange part. Each of the first and second flange parts has an inner wall surface extending substantially perpendicular to an axial direction of the winding core part and connected to the winding core part and an upper surface extending substantially perpendicular to the inner wall surface. The plate-like member is fixed to the upper surface of each of the first and second flange parts. Each of the first and second flange parts has a first cut part that is a portion at which at least a part of an edge part as a boundary between the inner wall surface and the upper surface is cut off and that can house at least one of the plurality of wires while preventing interference between the wire and the plate-like member.

According to the present invention, the first and second flange parts each have the first cut part, so that even when the winding position of the wires is displaced from a designed position, at least the last turn of the wire can be housed in the first cut part. Thus, it is possible to prevent interference between the wires and the plate-like member due to disordered winding of the wires.

In the present invention, the first cut part may be formed over at least an area covering the entire width of the winding core part so as to be able to house at least one of the plurality of wires while preventing interference between the wire and the plate-like member. This can reliably prevent interference between the wires and the plate-like member.

In the present invention, the first cut part may be formed over an entire width of the inner wall surface and the upper surface in a direction substantially perpendicular to the axial direction. This facilitates the production of the drum-shaped core using a die.

In the present invention, a step surface formed by the first cut part may constitute the same plane with the winding core part. This facilitates the production of the drum-shaped core using a die.

In the present invention, the first and second flange parts may each include a lower surface positioned on the side opposite to the upper surface, and the plurality of terminal electrodes may be formed on the lower surface. This prevents interference between the terminal electrodes and plate-like member, making it possible to simplify the shape of the plate-like member or that of the flange part of the drum-shaped core.

In the present invention, the first and second flange parts may each further have a second cut part at which at least a part of an edge part as the boundary between the inner wall surface and the lower surface is cut off. Thus, even when the winding position of the wires is displaced from a designed position, at least the last turn of the wire can be housed in the second cut part, so that it is possible to prevent the coil component from being mounted on a circuit board in an inclined state.

In the present invention, the second cut part may be formed over an entire width of the inner wall surface and the lower surface in a direction substantially perpendicular to the axial direction. This facilitates the production of the drum-shaped core using a die.

In the present invention, a step surface formed by the second cut part may constitute the same plane with the winding core part. This facilitates the production of the drum-shaped core using a die.

In the present invention, the step surface formed by the first cut part may have a slope. This facilitates the production of the drum-shaped core using a die.

In the present invention, the plurality of wires may include first and fourth wires wound in one direction around the winding core part to constitute a first winding layer and second and third wires wound in the opposite direction around the winding core part through the first winding layer to constitute a second winding layer. The first cut part may be configured to house the second or third wire. With this configuration, the coil component may be used as a pulse transformer, and interference between the upper wires which are easily disorderly wound and the plate-like member can be prevented.

In the present invention, the plate-like member may be made of a magnetic material. With this configuration, a closed magnetic path is formed by the drum-shaped core and plate-like member, thus enhancing inductance.

As described above, according to the present invention, it is possible to prevent interference between the wires and the plate-like member even when the winding position of the wires is displaced from a designed position.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
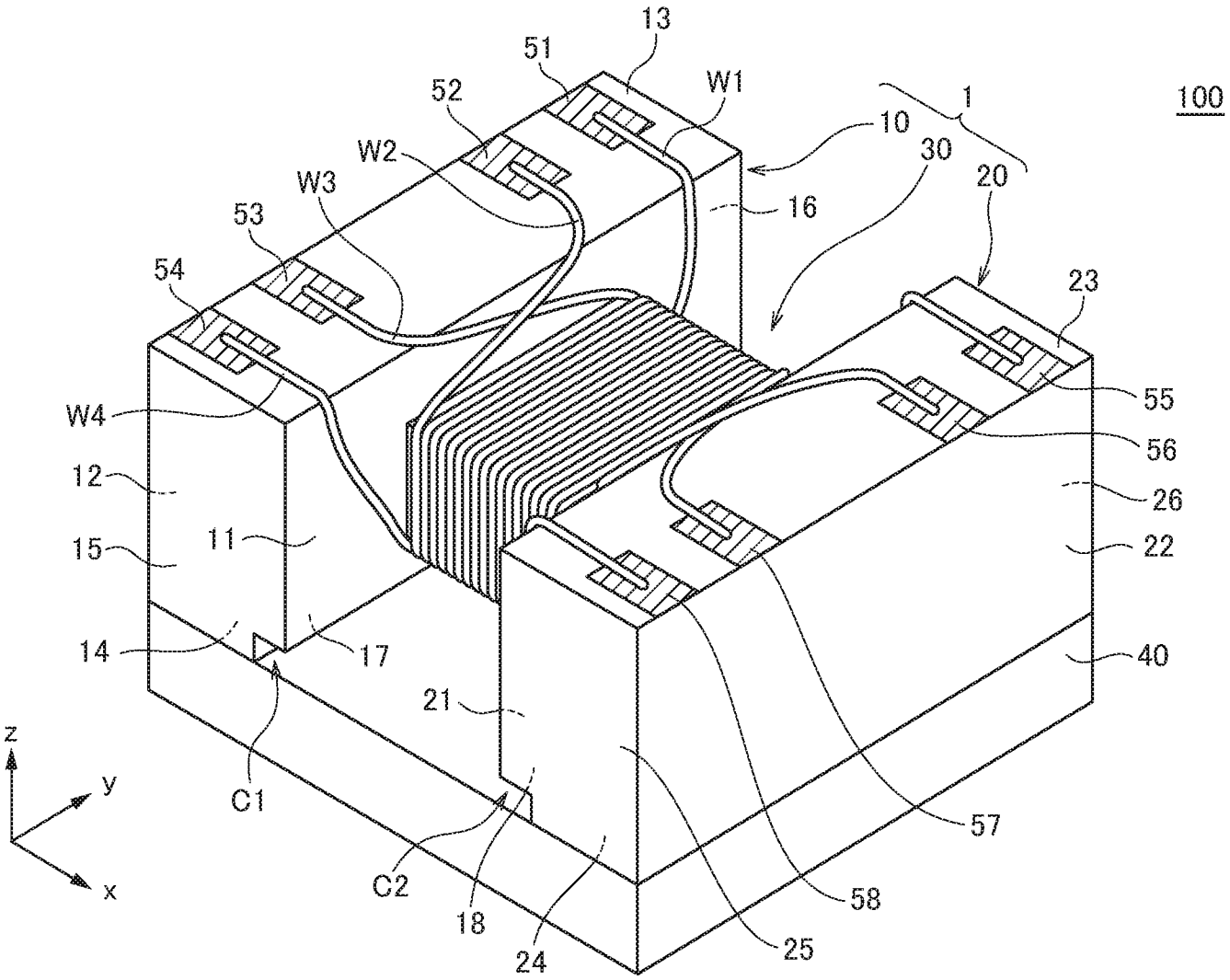
FIG. 1 is a schematic perspective view illustrating the outer structure of a coil component according to a first embodiment of the present invention.
Figure 2:
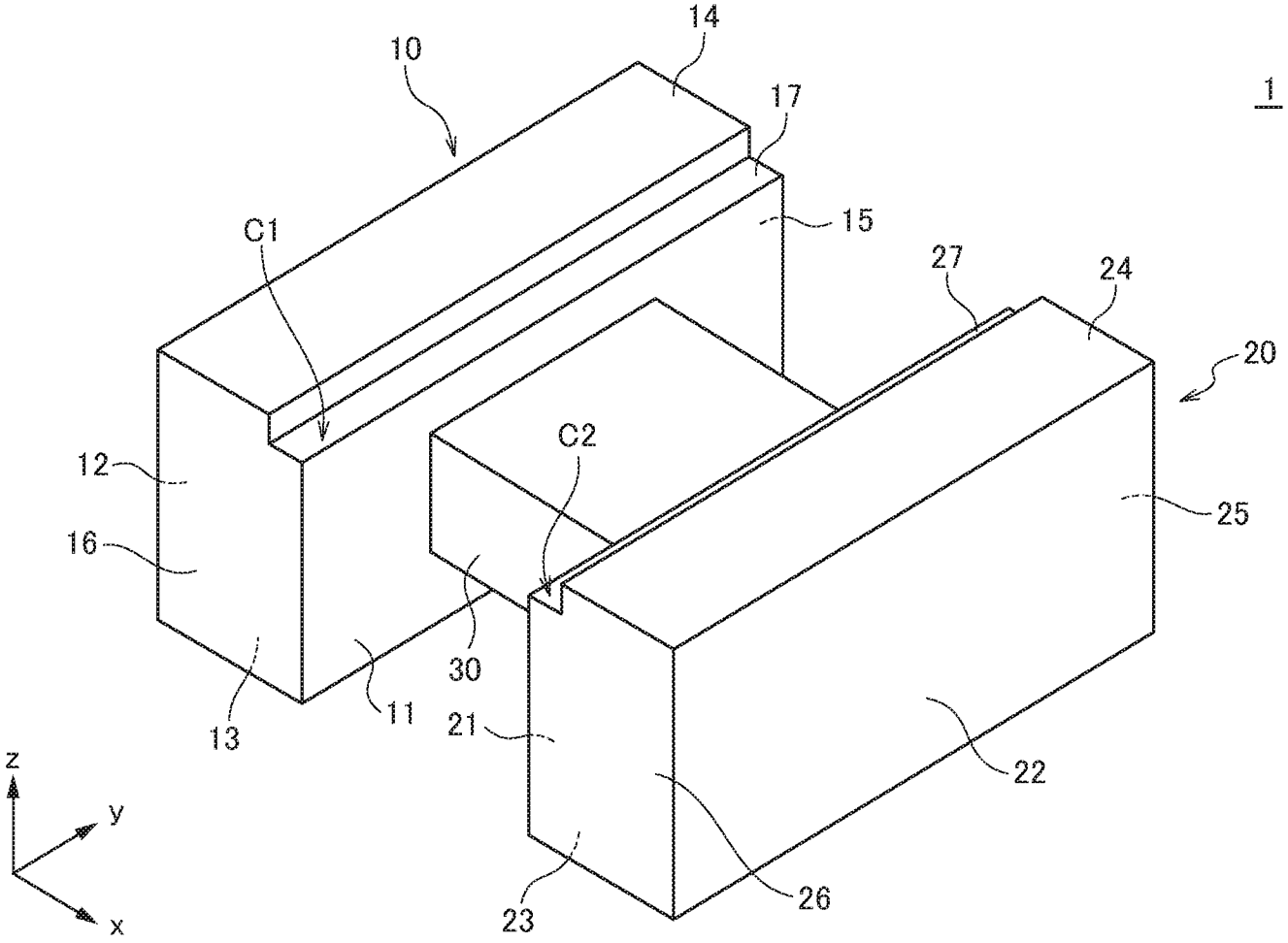
FIG. 2 is a schematic perspective view illustrating the outer structure of a drum-shaped core used in the coil component according to the first embodiment of the present invention.

FIG. 1 is a schematic perspective view illustrating the outer structure of a coil component 100 according to the first embodiment of the present invention. FIG. 2 is a schematic perspective view illustrating the outer structure of a drum-shaped core 1 used in the coil component 100 according to the present embodiment.

The coil component 100 according to the first embodiment is a surface-mount type pulse transformer and has a drum-shaped core 1, a plate-like core 40 bonded to the core 1, and four wires W1 to W4 wound around a winding core part 30 of the core 1 as illustrated in FIG. 1. However, the coil component according to the present invention is not limited to the pulse transformer, but may be a transformer component of another type, such as a balun transformer or a boosting transformer, or a filter component such as a common mode choke coil.

The cores 1 and 40 are each made of a magnetic material having comparatively high permeability, such as a sintered body of an Ni—Zn based ferrite or an Mn—Zn based ferrite. In general, a magnetic material having high permeability such as the Mn—Zn based ferrite is low in specific resistance and thus has conductivity.

The drum-shaped core 1 integrally has a rod-like winding core part 30 whose axis extends in the x-direction and first and second flange parts 10 and 20 provided at both ends of the winding core part 30 in the x-direction. The first flange part 10 has an inner wall surface 11 and an outer wall surface 12 which constitute the yz plane, a lower surface 13 and an upper surface 14 which constitute the xy plane, and side surfaces 15 and 16 which constitute the xz plane. Similarly, the second flange part 20 has an inner wall surface 21 and an outer wall surface 22 which constitute the yz plane, a lower surface 23 and an upper surface 24 which constitute the xy plane, and side surfaces 25 and 26 which constitute the xz plane.

The coil component 100 is a chip component mounted on the surface of a printed circuit board when used and is mounted with the lower surfaces 13 and 23 of the flange parts 10 and 20 facing the printed circuit board. The plate-like core 40 is fixed to the upper surfaces 14 and of the flange parts 10 and 20 with an adhesive. A closed magnetic loop is formed by the thus configured drum-shaped core 1 and plate-like core 40.

Four terminal electrodes 51 to 54 are arranged in the y-direction on the lower surface 13 of the first flange part 10, and four terminal electrodes 55 to 58 are arranged in the y-direction on the lower surface 23 of the second flange part 20. The terminal electrodes 51 to 54 may be formed over the lower surface 13 and outer wall surface 12, and the terminal electrodes 55 to 58 may be formed over the lower surface 23 and outer wall surface 22. Further, the terminal electrodes 51 to 58 may be formed not only on the lower surfaces 13 and 23, but also on their opposing upper surfaces 14 and 24. The terminal electrodes 51 to may each be a conductive film applied to the corresponding flange part 10 or 20 or may each be a terminal fitting.

As illustrated in FIG. 1, the four wires W1 to W4 are wound around the winding core part 30. One ends of the wires W1 to W4 are connected to their respective terminal electrodes 51 to 54, and the other ends thereof are connected to their respective terminal electrodes 55 to 58. Although not particularly limited, the wire connection can be achieved by thermocompression bonding or laser joining.

Although not particularly limited, the wire W1 is connected to the terminal electrodes 51 and 56, and the winding direction thereof is, for example, clockwise. The wire W2 is connected to the terminal electrodes 52 and 55, and the winding direction thereof is, for example, counterclockwise. The wire W3 is connected to the terminal electrodes 53 and 58, and the winding direction thereof is, for example, clockwise. The wire W4 is connected to the terminal electrodes 54 and 57, and the winding direction thereof is, for example, counterclockwise. With this configuration, for example, the terminal electrodes 51 and 52 can be used as the primary side input/output terminal of the pulse transformer, terminal electrodes 57 and 58 can be used as the secondary side input/output terminal of the pulse transformer, the terminal electrodes 55 and 56 can be used as the primary center tap of the pulse transformer, and the terminal electrodes 53 and 54 can be used as the secondary center tap of the pulse transformer. The terminal electrodes 55 and 56 constituting the primary center tap may be combined into a single terminal electrode. Similarly, the terminal electrodes 53 and 54 constituting the secondary center tap may be combined into a single terminal electrode.

As illustrated in FIGS. 1 and 2, the first flange part 10 has a cut part C1 at which an edge part as the boundary between the inner wall surface 11 and the upper surface 14 is cut off. Similarly, the second flange part 20 has a cut part C2 at which an edge part as the boundary between the inner wall surface 21 and the upper surface 24 is cut off. In the present embodiment, the cut part C1 is formed over the entire width of the inner wall surface 11 and upper surface 14 in the y-direction, and the cut part C2 is formed over the entire width of the inner wall surface 21 and upper surface 24 in the y-direction. Further, in the present embodiment, step surfaces 17 and 27 formed respectively by the cut parts C1 and C2 constitute the xy-plane. The difference in dimension in the z-direction between the upper surface (14, 24) and the step surface (17, 27) is larger than the diameter of each of the wires W1 to W4.

Figure 3:
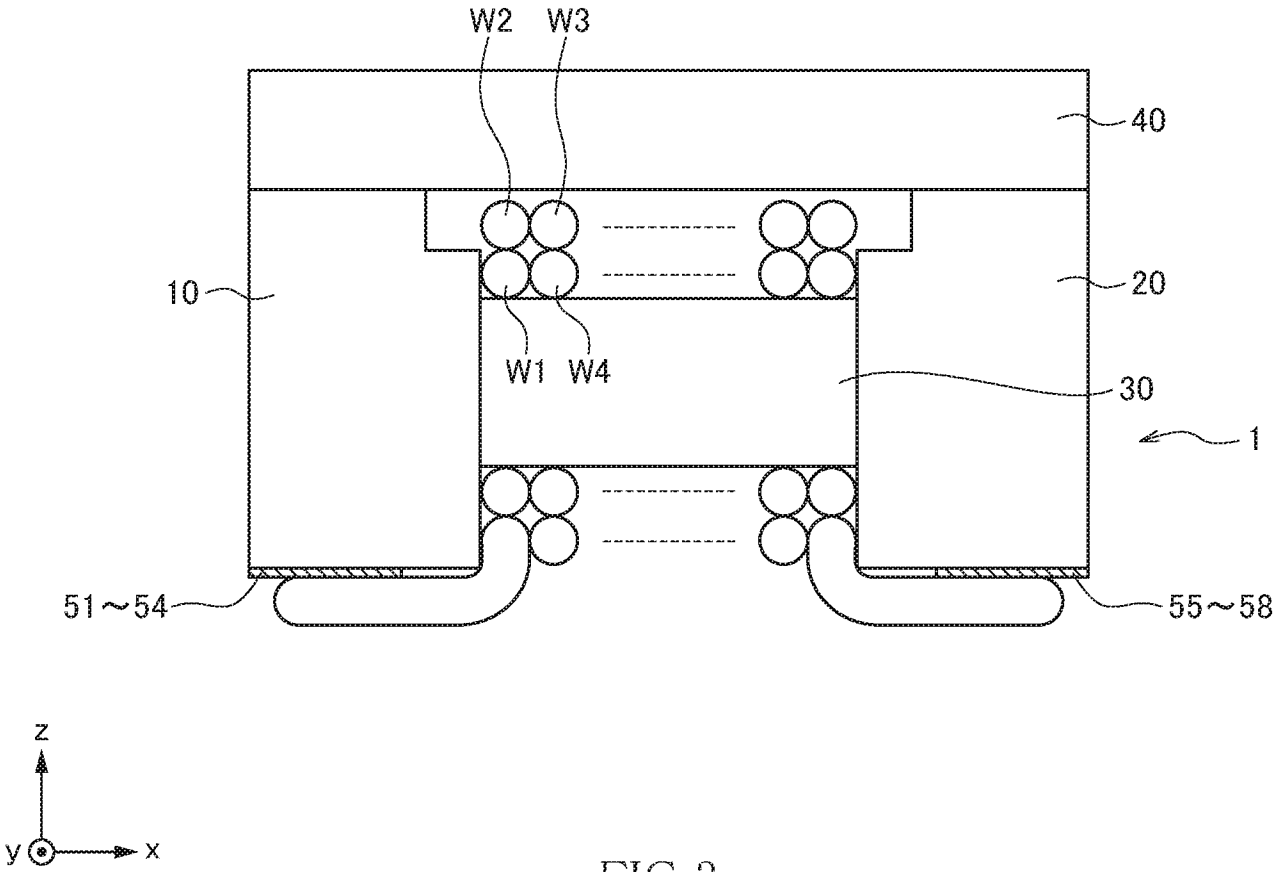
FIG. 3 is a side view of the coil component according to the first embodiment of the present invention as viewed in the y-direction where the wires are properly wound.

FIG. 3 is a side view of the coil component 100 according to the present embodiment as viewed in the y-direction.

As illustrated in FIG. 3, in the present embodiment, the wires W1 and W4 wound in one direction around the winding core part 30 constitute a first winding layer, and the wires W2 and W3 wound in the opposite direction around the winding core part 30 through the first winding layer constitute a second winding layer. FIG. 3 shows an example in which the wires W2 and W3 constituting the second winding layer are wound at proper positions.

The wires W2 and W3 constituting the second winding layer are wound on the first winding layer, so that the base surface on which they are wound is not flat unlike the case of the wires W1 and W4 constituting the first winding layer. In addition, the winding direction of the wires W2 and W3 constituting the second winding layer is opposite to the winding direction of the wires W1 and W4 constituting the first winding layer, so that the wires W2 and W3 cannot be wound along the valley lines of the first winding layer. Thus, a displacement occurs more easily in the wires W2 and W3 constituting the second winding layer than in the wires W1 and W4 constituting the first winding layer.

Figure 4:
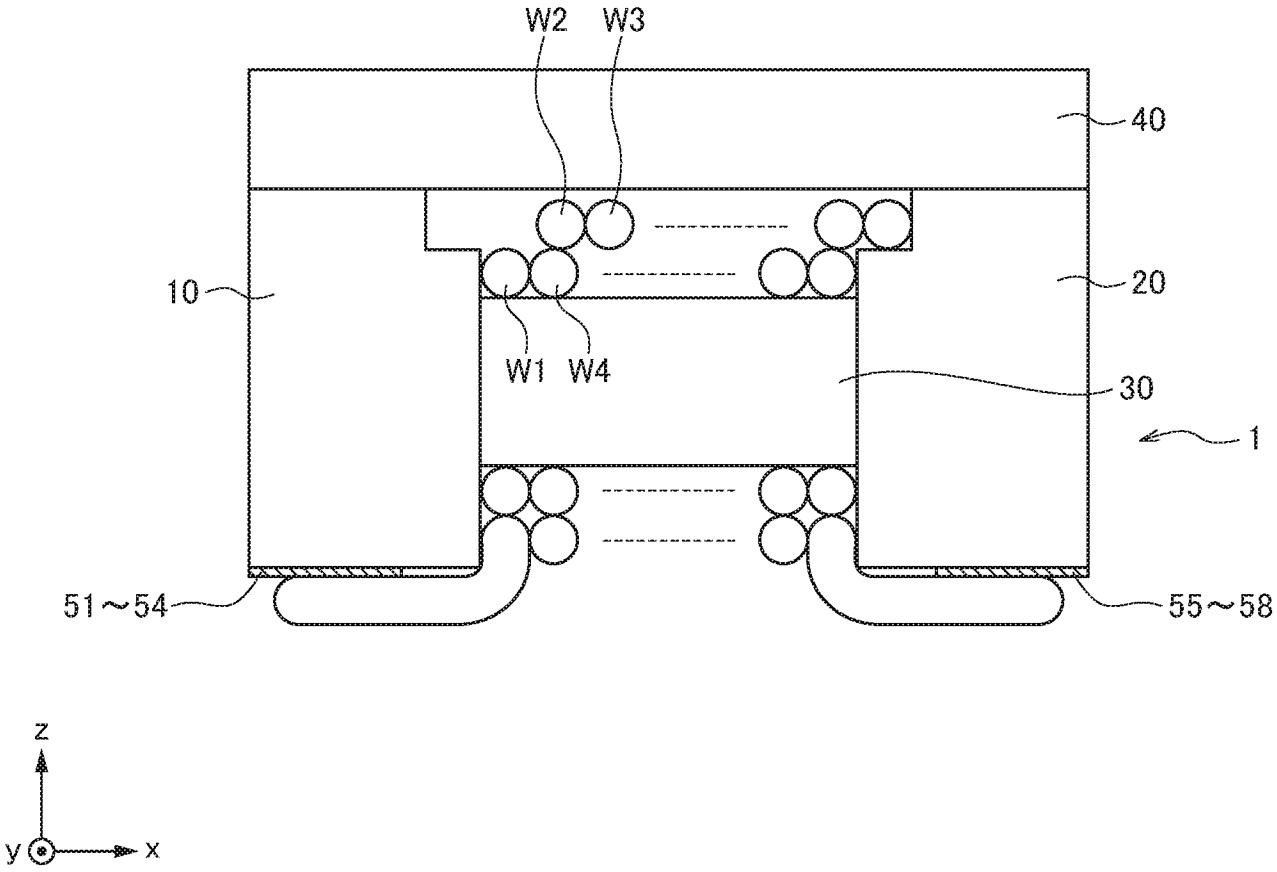
FIG. 4 is a side view of the coil component according to the first embodiment of the present invention as viewed in the y-direction where the wires are improperly wound.

However, in the present embodiment, the cut parts C1 and C2 are formed in the flange parts 10 and 20, respectively, so that even when a displacement occurs in the winding positions of the wires W2 and W3 constituting the second winding layer, the displaced wire W2 or W3 is housed in the cut part C1 or C2, respectively, as illustrated in FIG. 4. Thus, even when a displacement occurs in the winding positions of the wires W2 and W3, the wires W2 and W3 do not interfere with the plate-like core 40. This allows the flange parts 10 and 20 of the drum-shaped core 1 and the plate-like core 40 to be brought into tight contact with each other, preventing unintended magnetic gap and failure in appearance from occurring.

As described above, in the coil component 100 according to the present embodiment, the cut parts C1 and C2 are formed in the flange parts 10 and 20, respectively, so that even when a displacement occurs in the winding positions of the wires W2 and W3 constituting the second winding layer, interference between the wires W2, W3 and the core 40 can be prevented. In addition, in the present embodiment, the cut part C1 is formed over the entire width of the inner wall surface 11 and upper surface 14 in the y-direction, and the cut part C2 is formed over the entire width of the inner wall surface 21 and upper surface 24 in the y-direction, simplifying the shapes of the flange parts 10 and 20, so that there is no difficulty in producing the core 1 using a die.

Second Embodiment

Figure 5:
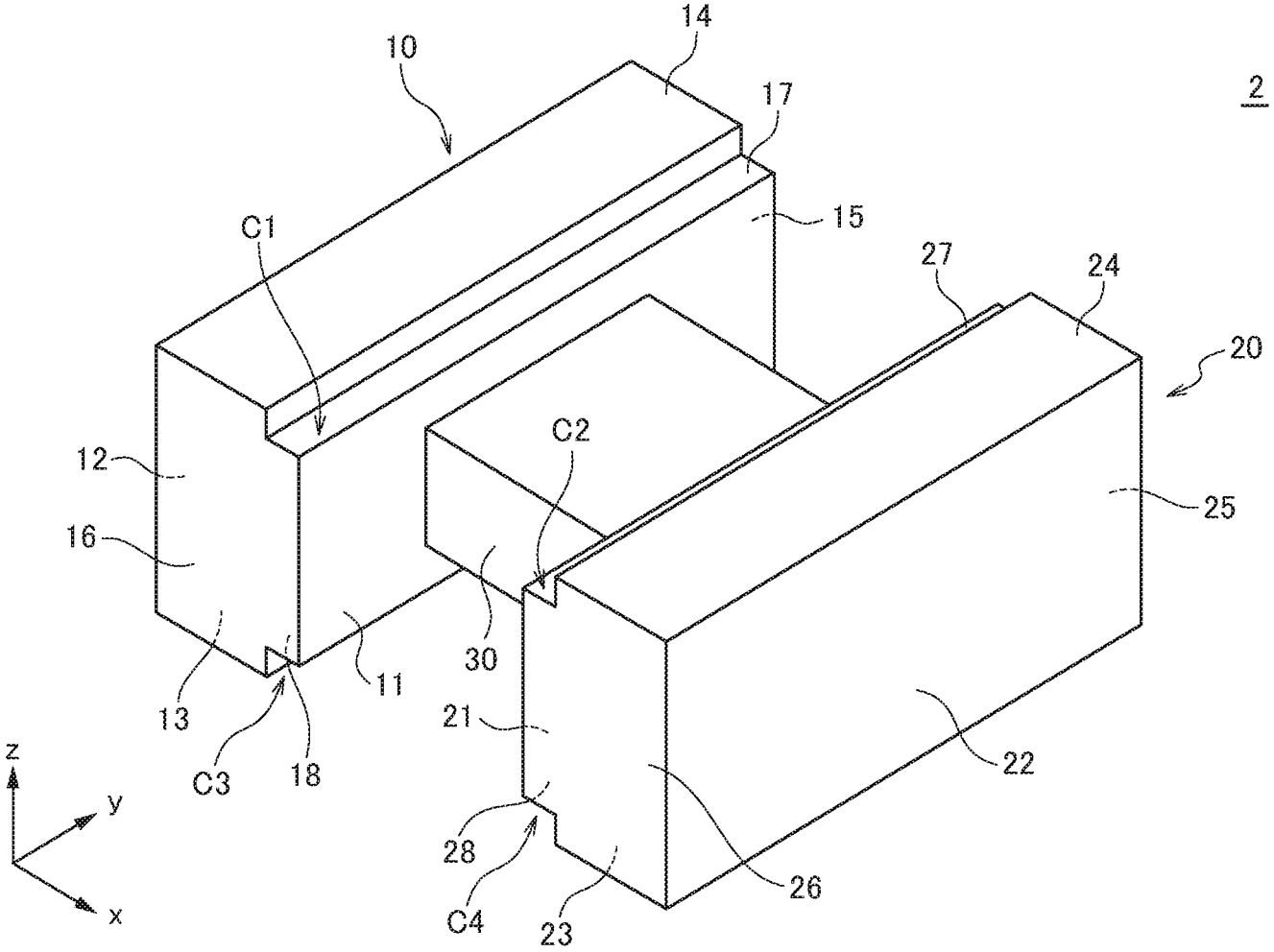
FIG. 5 is a schematic perspective view illustrating the outer structure of a drum-shaped core used in the coil component according to a second embodiment of the present invention.

FIG. 5 is a schematic perspective view illustrating the outer structure of a drum-shaped core 2 used in the coil component according to the second embodiment of the present invention.

As illustrated in FIG. 5, the drum-shaped core 2 used in the second embodiment differs from the drum-shaped core 1 used in the first embodiment in that the first and second flange parts 10 and 20 further have a cut part C3 and a cut part C4, respectively. Other configurations are basically the same as those of the drum-shaped core 1 used in the first embodiment, so the same reference numerals are given to the same elements, and overlapping description will be omitted.

The cut part C3 is a portion at which an edge part as the boundary between the inner wall surface 11 of the first flange part 10 and the lower surface 13 thereof is cut off. Similarly, the cut part C4 is a portion at which an edge part as the boundary between the inner wall surface 21 of the second flange part 20 and the lower surface 23 thereof is cut off. In the present embodiment, the cut part C3 is formed over the entire width of the inner wall surface 11 and lower surface 13 in the y-direction, and the cut part C4 is formed over the entire width of the inner wall surface 21 and lower surface 23 in the y-direction. Further, in the present embodiment, step surfaces 18 and 28 formed respectively by the cut parts C3 and C4 constitute the xy-plane. The difference in dimension in the z-direction between the lower surface (13, 23) and the step surface (18, 28) is larger than the diameter of each of the wires W1 to W4.

Figure 6:
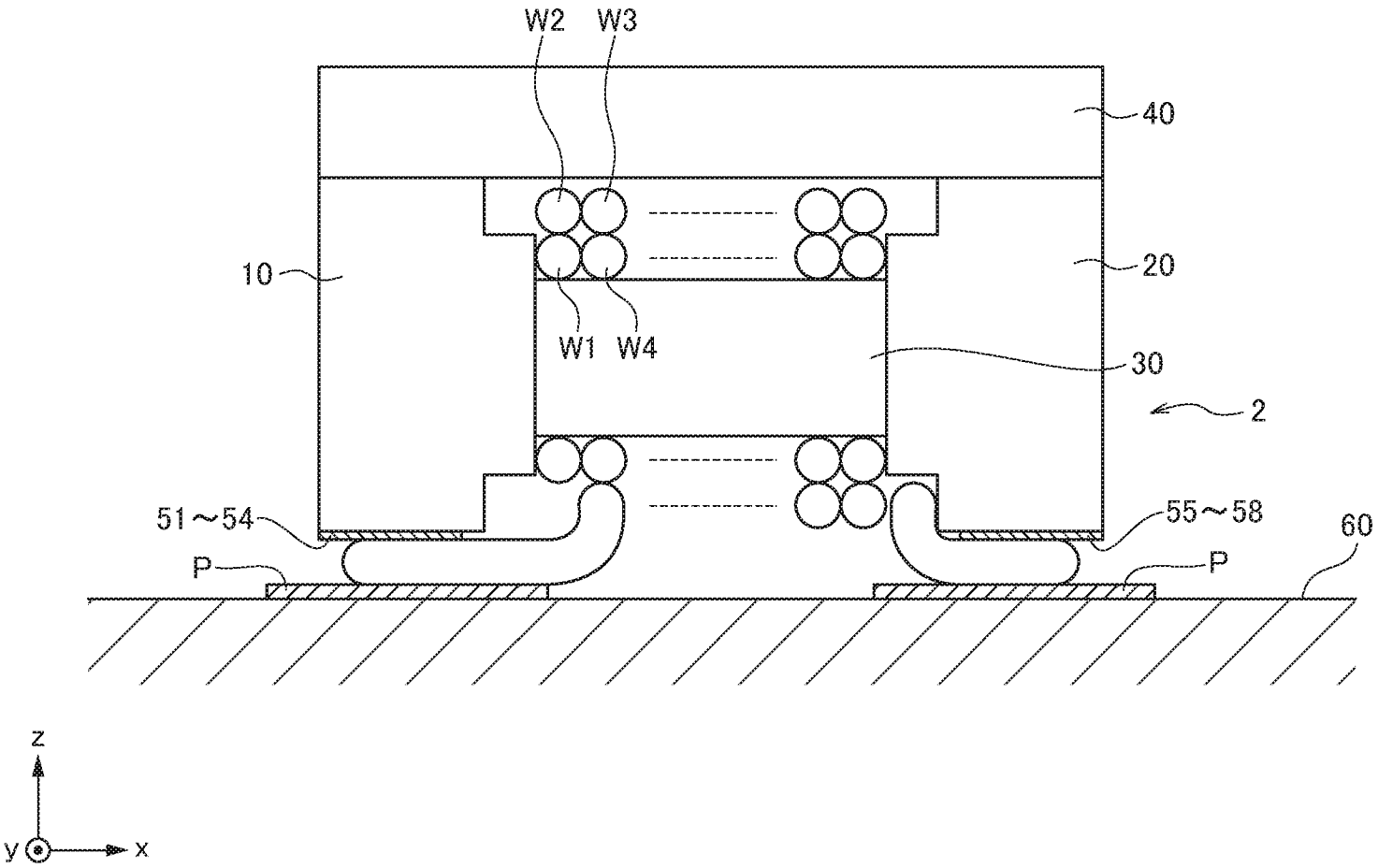
FIG. 6 is a side view of the coil component according to the second embodiment of the present invention as viewed in the y-direction where the wires are improperly wound.

With the above configuration, even when a displacement occurs in the winding positions of the wires W2 and W3 constituting the second winding layer, the displaced wire W2 or W3 is housed in the cut part C3 or C4, respectively, as illustrated in FIG. 6. Thus, even when a displacement occurs in the winding positions of the wires W2 and W3, it is possible to prevent the coil component 100 from being mounted in an inclined state when the coil component 100 is mounted on a mounting substrate 60 having a land pattern P. In addition, in the present embodiment, the cut part C3 is formed over the entire width of the inner wall surface 11 and lower surface 13 in the y-direction, and the cut part C4 is formed over the entire width of the inner wall surface 21 and lower surface 23 in the y-direction, thus simplifying the shapes of the flange parts 10 and 20, so that there is no difficulty in producing the core 2 using a die.

Third Embodiment

Figure 7:
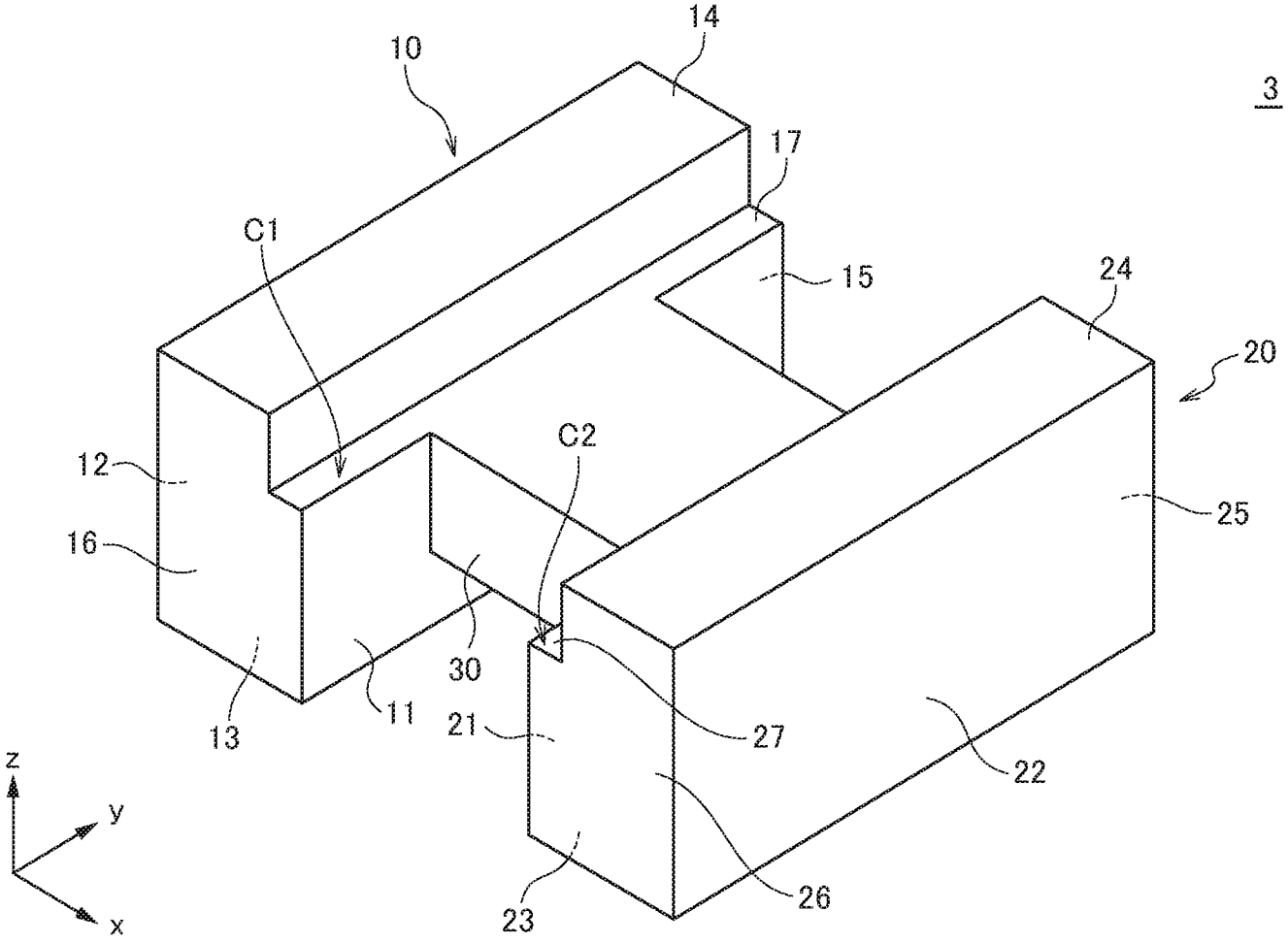
FIG. 7 is a schematic perspective view illustrating the outer structure of a drum-shaped core used in the coil component according to a third embodiment of the present invention.

FIG. 7 is a schematic perspective view illustrating the outer structure of a drum-shaped core 3 used in the coil component according to the third embodiment of the present invention.

As illustrated in FIG. 7, the drum-shaped core 3 used in the third embodiment differs from the drum-shaped core 1 used in the first embodiment in that the step surfaces 17 and 27 formed respectively by the cut parts C1 and C2 constitute the same plane as the xy plane on the upper surface side of the winding core part 30. Other configurations are basically the same as those of the drum-shaped core 1 used in the first embodiment, so the same reference numerals are given to the same elements, and overlapping description will be omitted.

With this configuration, the same effects as those in the first embodiment can be obtained. Further, the difference in dimension in the z-direction between the upper surface (14, 24) and step surface (17, 27) is increased, so that a disorderly wound wire can be easily housed in the cut part C1 or C2 and, in some cases, two or more wires can be housed in the cut part C1 or C2. In addition, the step surfaces 17 and 27 constitute the same plane as the winding core part 30, making the shape of the drum-shaped core 3 simpler, which in turn further facilitates the production of the core 3 using a die.

Fourth Embodiment

Figure 8:
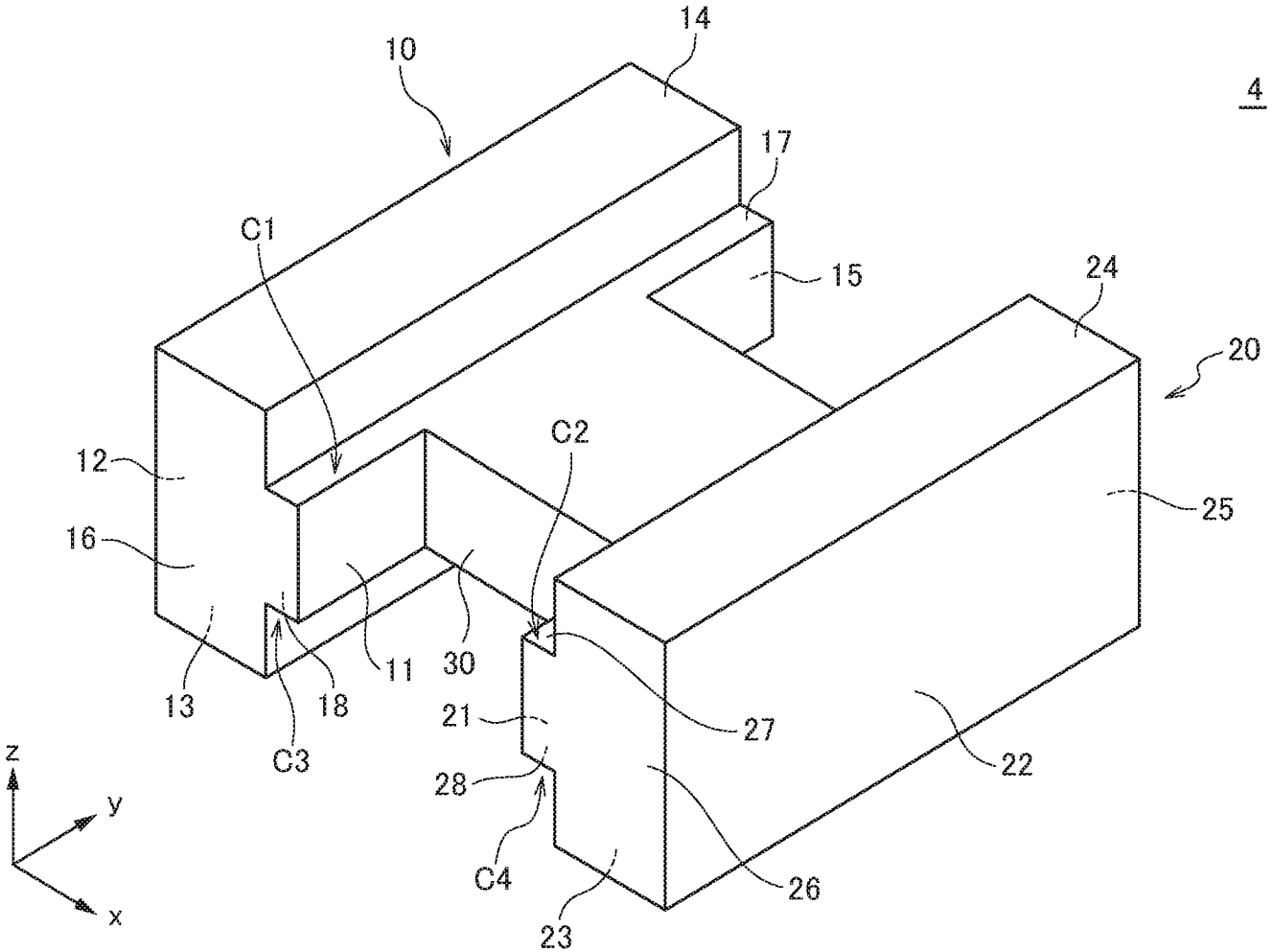
FIG. 8 is a schematic perspective view illustrating the outer structure of a drum-shaped core used in the coil component according to a fourth embodiment of the present invention.

FIG. 8 is a schematic perspective view illustrating the outer structure of a drum-shaped core 4 used in the coil component according to the fourth embodiment of the present invention.

As illustrated in FIG. 8, the drum-shaped core 4 used in the fourth embodiment differs from the drum-shaped core 3 used in the third embodiment in that the step surfaces 18 and 28 formed respectively by the cut parts C3 and C4 constitute the same plane as the xy plane on the lower surface side of the winding core part 30. Other configurations are basically the same as those of the drum-shaped core 3 used in the third embodiment, so the same reference numerals are given to the same elements, and overlapping description will be omitted.

With this configuration, the same effects as those in the third embodiment can be obtained. Further, the difference in dimension in the z-direction between the lower surface (13, 23) and the step surface (18, 28) is increased, so that a disorderly wound wire can be easily housed in the cut part C3 or C4 and, in some cases, two or more wires can be housed in the cut part C3 or C4. In addition, the step surfaces 18 and 28 constitute the same plane as the winding core part 30, making the shape of the drum-shaped core 4 simpler, which in turn further facilitates the production of the core 4 using a die.

Figure 9:
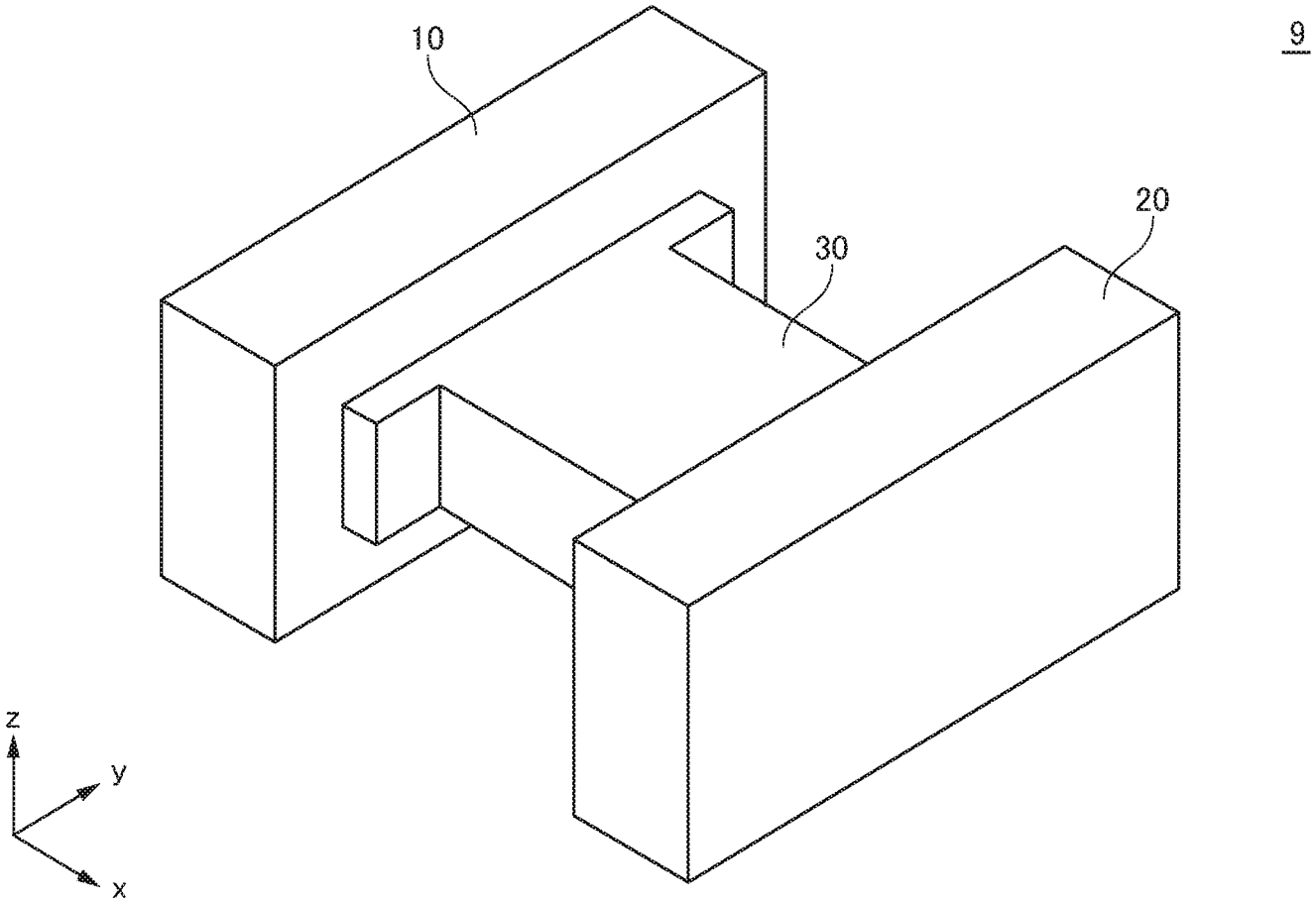
FIG. 9 is a schematic perspective view illustrating the outer structure of a drum-shaped according to a comparative example.

In the present embodiment as well, preferably, the cut part (C1 to C4) is formed essentially in the flange part (10 and 20). That is, as illustrated in FIG. 9, which illustrates a drum-shaped core 9, when a shape similar to the cut part (C1 to C4) is formed in the winding core part 30, the length of the winding core part 30 in the x-direction is simply increased, resulting in increase in the size of the entire coil component. Thus, even when the step surface (17, 27, 18, 28) is formed in the same plane as the surface of the winding core part 30, it is possible to prevent increase in size of the coil component by forming the step surface (17, 27, 18, 28) as a part of the flange part (10, 20). In other words, the side surface (15, 16, 25, 26) of the flange part (10, 20) is preferably a flat surface having no step, and the shape of the side surface (15, 16, 25, 26) of the flange part (10, 20) is preferably reflected on the step surface (17, 27, 18, 28).

Fifth Embodiment

Figure 10:
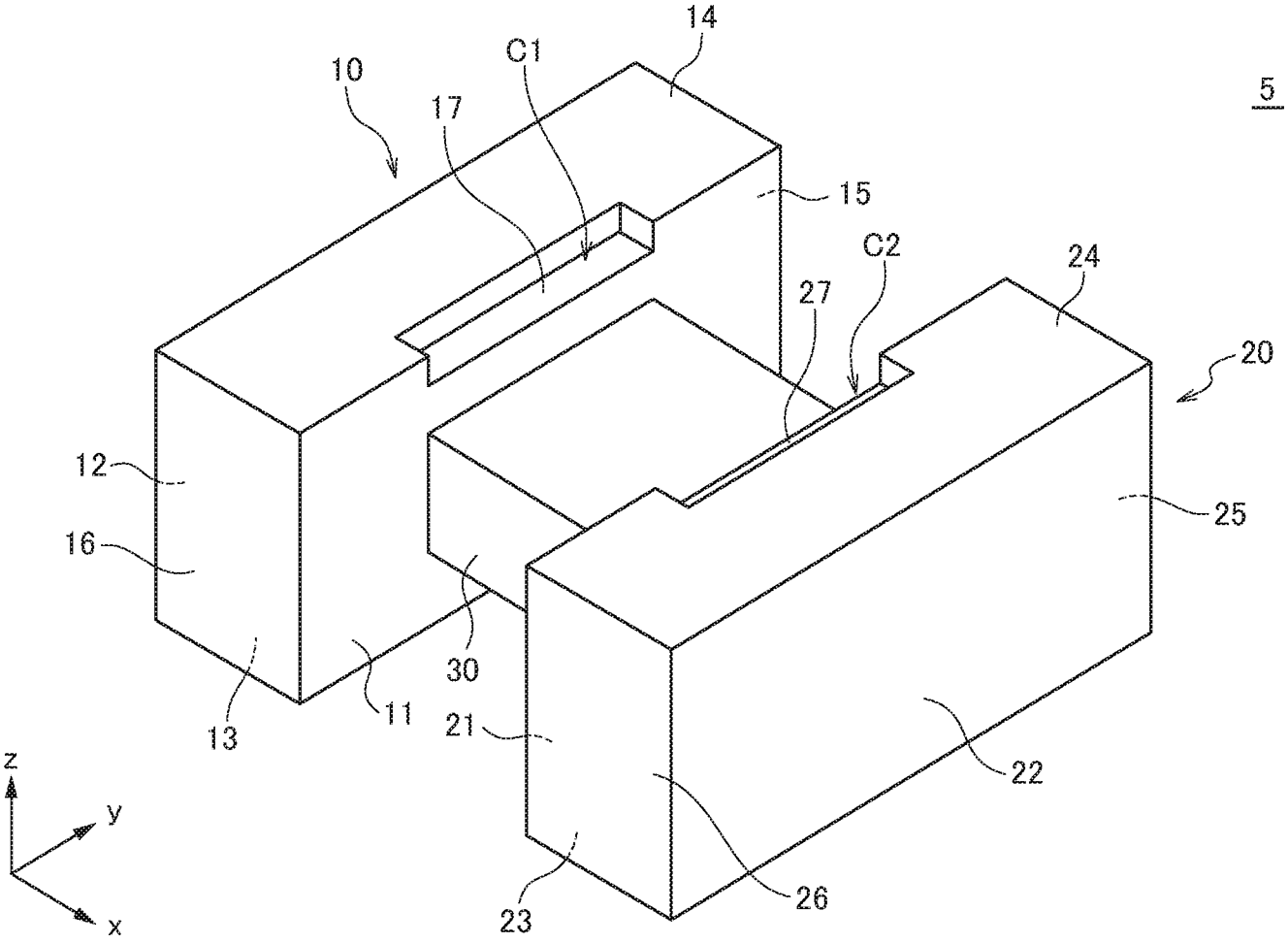
FIG. 10 is a schematic perspective view illustrating the outer structure of a drum-shaped core used in the coil component according to a fifth embodiment of the present invention.

FIG. 10 is a schematic perspective view illustrating the outer structure of a drum-shaped core 5 used in the coil component according to the fifth embodiment of the present invention.

As illustrated in FIG. 10, the drum-shaped core 5 used in the fifth embodiment differs from the drum-shaped core 1 used in the first embodiment in that the cut part (C1, C2) is not formed over the entire width of the flange part (10, 20) in the y-direction but formed partially in the y-direction of the flange part (10, 20) such that the position of the cut part (C1, C2) at least overlaps the entire area of the winding core part 30. Other configurations are basically the same as those of the drum-shaped core 1 used in the first embodiment, so the same reference numerals are given to the same elements, and overlapping description will be omitted.

Even with this configuration, the same effects as those in the first embodiment can be obtained. Further, the volume of the core 5 can be ensured to thereby make it possible to obtain high magnetic characteristics.

Sixth Embodiment

Figure 11:
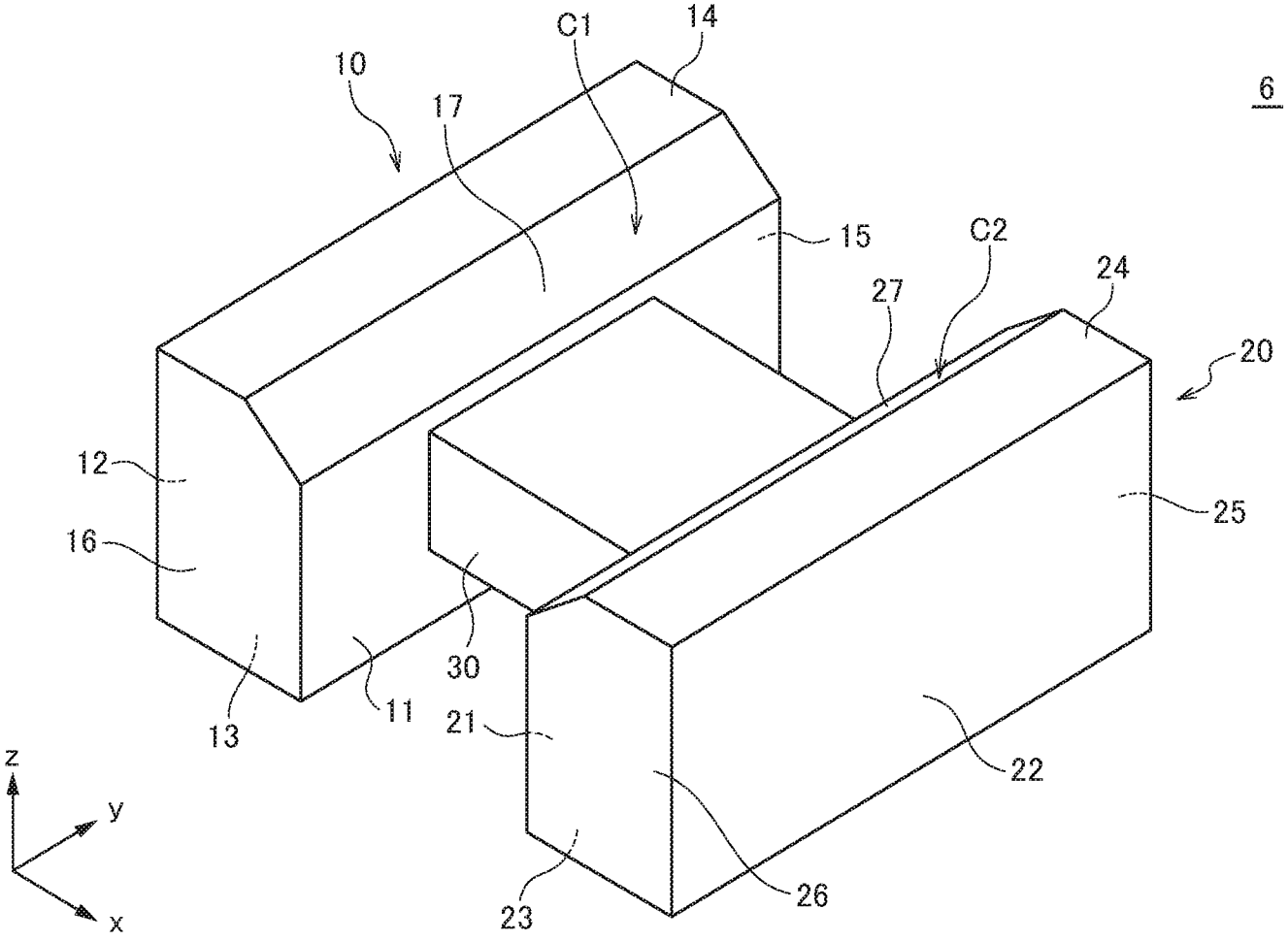
FIG. 11 is a schematic perspective view illustrating the outer structure of a drum-shaped core used in the coil component according to a sixth embodiment of the present invention.

FIG. 11 is a schematic perspective view illustrating the outer structure of a drum-shaped core 6 used in the coil component according to the sixth embodiment of the present invention.

As illustrated in FIG. 11, the drum-shaped core 6 used in the sixth embodiment differs from the drum-shaped core 1 used in the first embodiment in that the step surfaces 17 and 27 formed respectively by the cut parts C1 and C2 each have a slope. Other configurations are basically the same as those of the drum-shaped core 1 used in the first embodiment, so the same reference numerals are given to the same elements, and overlapping description will be omitted.

Even with this configuration, the same effects as those in the first embodiment can be obtained as long as the wire W2 or W3 can be housed in the cut part C1 or C2, respectively.

Seventh Embodiment

Figure 12:
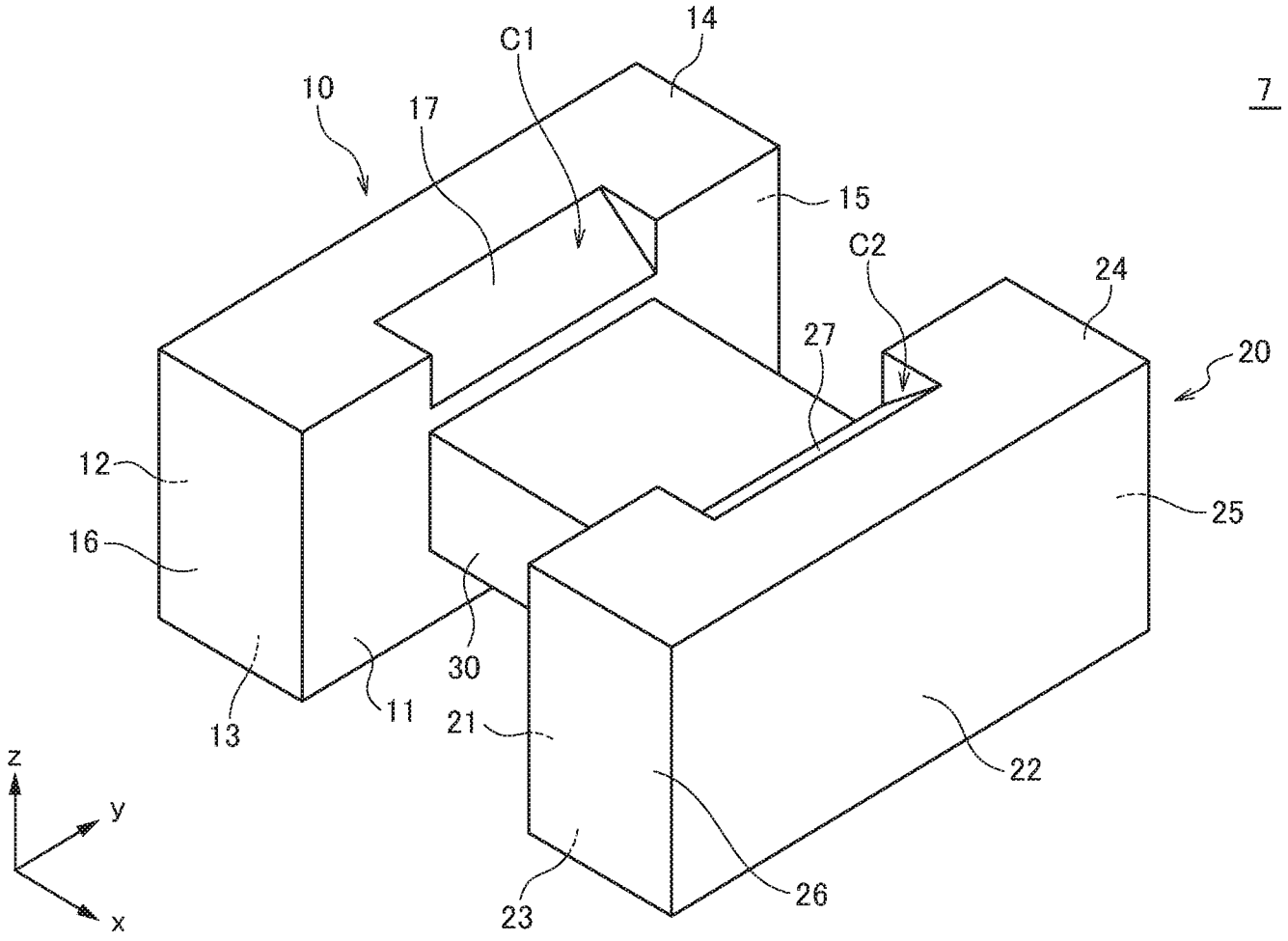
FIG. 12 is a schematic perspective view illustrating the outer structure of a drum-shaped core used in the coil component according to a seventh embodiment of the present invention.

FIG. 12 is a schematic perspective view illustrating the outer structure of a drum-shaped core 7 used in the coil component according to the seventh embodiment of the present invention.

As illustrated in FIG. 12, the drum-shaped core 7 used in the seventh embodiment differs from the drum-shaped core 6 used in the sixth embodiment in that the cut part (C1, C2) is not formed over the entire width of the flange part (10, 20) in the y-direction but formed partially in the y-direction of the flange part (10, 20) such that the position of the cut part (C1, C2) at least overlaps the entire area of the winding core part 30. Other configurations are basically the same as those of the drum-shaped core 6 used in the sixth embodiment, so the same reference numerals are given to the same elements, and overlapping description will be omitted.

Even with this configuration, the same effects as those in the sixth embodiment can be obtained. Further, the volume of the core 7 can be ensured to thereby make it possible to obtain high magnetic characteristics.

It is apparent that the present invention is not limited to the above embodiments, but may be modified and changed without departing from the scope and spirit of the invention.

For example, although the plate-like core 40 is used in the above embodiments, a plate-like member corresponding to the core 40 need not be a magnetic member, but may be a non-magnetic member.

What is claimed is:

1. A coil component comprising:

a drum-shaped core including:

a winding core part;

a first flange part provided at one axial end of the winding core part; and a second flange part provided at other axial end of the winding core part;

a plate-like member;

a plurality of terminal electrodes provided on each of the first and second flange parts; and a plurality of wires wound around the winding core part such that one end of each wire is connected to any one of the plurality of terminal electrodes provided on the first flange part and other end of each wire is connected to any one of the plurality of terminal electrodes provided on the second flange part, wherein each of the first and second flange parts has an inner wall surface extending substantially perpendicular to an axial direction of the winding core part and connected to the winding core part, an upper surface extending substantially perpendicular to the inner wall surface, and a lower surface positioned opposite to the upper surface, wherein the plate-like member is fixed to the upper surface of each of the first and second flange parts, wherein the plurality of terminal electrodes are formed on the lower surface, wherein the one end of each wire is bonded to any one of the plurality of terminal electrodes provided on the lower surface of the first flange part, wherein the other end of each wire is bonded to any one of the plurality of terminal electrodes provided on the lower surface of the second flange part, and wherein each of the first and second flange parts has a first cut part that is a portion at which at least a part of an edge part as a boundary between the inner wall surface and the upper surface is cut off and that can house at least one of the plurality of wires while preventing interference between the wire and the plate-like member.

2. The coil component as claimed in claim 1, wherein a step surface formed by the first cut part has a slope.

3. The coil component as claimed in claim 1, wherein the plurality of wires include first and fourth wires wound in one direction around the winding core part to constitute a first winding layer and second and third wires wound in an opposite direction around the winding core part on the first winding layer to constitute a second winding layer, and wherein the first cut part is configured to house the second or third wire.

4. The coil component as claimed in claim 1, wherein the first cut part is formed over at least an area covering an entire width of the winding core part so as to be able to house at least one of the plurality of wires while preventing interference between the wire and the plate-like member.

5. The coil component as claimed in claim 4, wherein the first cut part is formed over an entire width of the inner wall surface and the upper surface in a direction substantially perpendicular to the axial direction.

6. The coil component as claimed in claim 5, wherein a step surface formed by the first cut part constitutes a same plane with the winding core part.

7. The coil component as claimed in claim 1, wherein each of the first and second flange parts further has a second cut part at which at least a part of an edge part as the boundary between the inner wall surface and the lower surface is cut off.

8. The coil component as claimed in claim 7, wherein the second cut part is formed over an entire width of the inner wall surface and the lower surface in a direction substantially perpendicular to the axial direction.

9. The coil component as claimed in claim 8, wherein a step surface formed by the second cut part constitutes a same plane with the winding core part.

10. The coil component as claimed in claim 1, wherein the plate-like member is made of a magnetic material.

11. The coil component as claimed in claim 1, wherein the upper surface of each of the first and second flange parts is free from the terminal electrodes.

12. The coil component as claimed in claim 1, wherein the first cut part of each of the first and second flange parts is free from the terminal electrodes.

13. A coil component comprising:

a core including a winding core part extending in a first direction and a flange part provided at one end of the winding core part in the first direction, the flange part having a first surface substantially parallel with the first direction and a second surface positioned opposite to the first surface;

a plate-like member fixed to the first surface of flange part;

a terminal electrode provided on the second surface; and a wire wound around the winding core part and bonded to the terminal electrode on the second surface, wherein the first surface of flange part has a cut part greater in size than a diameter of the wire, and wherein a part of the wire is housed in the cut part.

14. A coil component comprising:

a drum-shaped core including:

a winding core part;

a first flange part provided at one axial end of the winding core part; and a second flange part provided at other axial end of the winding core part;

a plate-like member;

a plurality of terminal electrodes provided on each of the first and second flange parts; and a plurality of wires wound around the winding core part such that one end of each wire is connected to any one of the plurality of terminal electrodes provided on the first flange part and other end of each wire is connected to any one of the plurality of terminal electrodes provided on the second flange part, wherein each of the first and second flange parts has an inner wall surface extending substantially perpendicular to an axial direction of the winding core part and connected to the winding core part and an upper surface extending substantially perpendicular to the inner wall surface, wherein the plate-like member is fixed to the upper surface of each of the first and second flange parts, wherein each of the first and second flange parts has a first cut part that is a portion at which at least a part of an edge part as a boundary between the inner wall surface and the upper surface is cut off and that can house at least one of the plurality of wires while preventing interference between the wire and the plate-like member, and wherein the first cut part is formed over at least an area covering an entire width of the winding core part so as to be able to house at least one of the plurality of wires while preventing interference between the wire and the plate-like member.

15. The coil component as claimed in claim 14, wherein the first cut part is formed over an entire width of the inner wall surface and the upper surface in a direction substantially perpendicular to the axial direction.

16. The coil component as claimed in claim 15, wherein a step surface formed by the first cut part constitutes a same plane with the winding core part.

17. A coil component comprising:

a drum-shaped core including:

a winding core part;

a first flange part provided at one axial end of the winding core part; and a second flange part provided at other axial end of the winding core part;

a plate-like member;

a plurality of terminal electrodes provided on each of the first and second flange parts; and a plurality of wires wound around the winding core part such that one end of each wire is connected to any one of the plurality of terminal electrodes provided on the first flange part and other end of each wire is connected to any one of the plurality of terminal electrodes provided on the second flange part, wherein each of the first and second flange parts has an inner wall surface extending substantially perpendicular to an axial direction of the winding core part and connected to the winding core part and an upper surface extending substantially perpendicular to the inner wall surface, wherein the plate-like member is fixed to the upper surface of each of the first and second flange parts, wherein each of the first and second flange parts has a first cut part that is a portion at which at least a part of an edge part as a boundary between the inner wall surface and the upper surface is cut off and that can house at least one of the plurality of wires while preventing interference between the wire and the plate-like member, wherein the plurality of wires include first and fourth wires wound in one direction around the winding core part to constitute a first winding layer and second and third wires wound in an opposite direction around the winding core part on the first winding layer to constitute a second winding layer, and wherein the first cut part is configured to house the second or third wire.

* * * * *